US005205345A

United States Patent [19]

McClellan et al.

[11] Patent Number: 5,205,345

[45] Date of Patent: Apr. 27, 1993

[54] METHOD AND APPARATUS FOR SLAB WIDTH CONTROL

[75] Inventors: John T. McClellan, Farmdale, Ohio; John W. Grove, Seneca, Pa.; Frank Kowalczyk, Lowellville, Ohio

[73] Assignee: Acutus Industries, Pontiac, Mich.

[21] Appl. No.: 741,284

[22] Filed: Aug. 7, 1991

[51] Int. Cl.[5] ..... B22D 11/04; B22D 11/16

[52] U.S. Cl. ..... 164/452; 164/154; 164/436; 164/491

[58] Field of Search ..... 164/452, 154, 491, 436

[56] References Cited

U.S. PATENT DOCUMENTS

| | | | |
|---|---|---|---|
| 3,478,808 | 11/1969 | Adams | 164/454 |
| 3,926,244 | 12/1975 | Meier et al. | 164/491 X |
| 4,171,719 | 10/1979 | Wunnenberg et al. | 164/436 X |
| 4,304,290 | 12/1981 | Wolf | 164/452 |
| 4,413,667 | 11/1983 | Schrewe et al. | 164/452 X |
| 4,635,704 | 1/1987 | Chielens et al. | 164/452 |

FOREIGN PATENT DOCUMENTS

| | | | |
|---|---|---|---|
| 3009697 | 10/1981 | Fed. Rep. of Germany | 164/436 |
| 2552692 | 4/1985 | France | 164/491 |
| 57-94450 | 6/1982 | Japan | 164/452 |
| 59-73163 | 4/1984 | Japan | 164/452 |

*Primary Examiner*—J. Reed Batten, Jr.
*Attorney, Agent, or Firm*—Dykema Gossett

[57] ABSTRACT

The width of a mold is controlled effectively to produce a slab having a desired and constant width associated therewith. More particularly, the speed of the output slab and the temperature of the molten metal contained within tundish are measured and the pressure exerted by the received molten metal within mold is determined. These measured and determined values are used to appropriately modify the width of the mold so as to produce a slab of constant width.

8 Claims, 5 Drawing Sheets

METHOD AND APPARATUS FOR SLAB WIDTH CONTROL

BACKGROUND OF THE INVENTION

1. Field of the Invention

This invention relates to a method and an apparatus for slab width control and more particularly, to a method and apparatus for allowing a casting mold to produce a steel slab having a substantially constant width.

2. Discussion

Steel casting molds are normally adapted to receive molten metal and to use the metal to produce a continuous slab of steel. The slab is often cut into various lengths, each of which is used in the manufacture of diverse products. Each manufacturing process requires slab lengths of a constant and certain width.

These molds usually have means to control the output slab width, based on a desired slab width. Each slab width also requires a certain mold taper. That is, an initial mold width and taper, associated with the desired slab width, is usually set before the metal is poured and modified for different required slab widths. Casting parameter variations, such as temperature, line speed and ferrostatic pressure cause the mold to produce a portion of the slab having a different width, from that of the initially cast portion. Consequently, the produced slab is of a varying width.

This lack of slab width control is particularly troublesome in applications requiring long slab lengths of a relatively large width, where the actually produced slab has long lengths of a very small width. In this situation, most of the slab is wasted or used for an alternate application. Moreover, even if the produced slab has a wider than desired width, it still must be cut, or sized by strip mill edgers in order to ensure a constant slab width. The edgers are relatively inefficient and expensive. Moreover, many mills do not ever have the edger capacity to appropriately size the slabs. Therefore, these slabs cannot be processed unless the slabs are actually cut to size.

SUMMARY OF THE INVENTION

According to the teachings of a first aspect of the present invention, a slab width controller is provided for use in combination with a mold which is adapted to receive molten metal at a certain temperature and which is adapted to output, at a certain speed, a metal slab therefrom. More particularly, the slab width controller comprises determining means for determining the certain speed; and width means, coupled to the determining means, for specifying a width of the mold based upon the determined speed and for adjusting the mold so as to cause the mold to have the specified width.

According to the teachings of another aspect of the present invention, a method is provided for producing a slab having a constant width from a casting mold having opposite and movable narrow endwalls. The endwalls are adapted to be engaged at opposite sides thereof by opposite broad sidewalls. The mold is further adapted to receive molten metal, of a certain grade and temperature, and to output, at a certain speed, a metal slab therefrom. The received metal is effective to exert a certain pressure within the mold.

The method comprises the steps of determining the grade of the molten metal; determining an initial position for each of the endwalls by use of the determined grade; placing each of the endwalls at their respective determined endwall position; measuring the temperature; determining the ferrostatic pressure; measuring the certain speed; determining a second position for at least one of the endwalls by use of the measured temperature, the pressure, and the certain speed; and moving at least one of the endwalls to the respective determined second position associated therewith.

Further objects, features and advantages of the invention will become apparent from consideration of the following description and the appended claims when taken in conjunction with the accompanying drawings.

BRIEF DESCRIPTION OF THE DRAWINGS

Various advantages of the present invention will become apparent to those skilled in the art by reading the following specification and by reference to the following drawings in which.

DETAILED DESCRIPTION OF THE INVENTION

Figure 1:
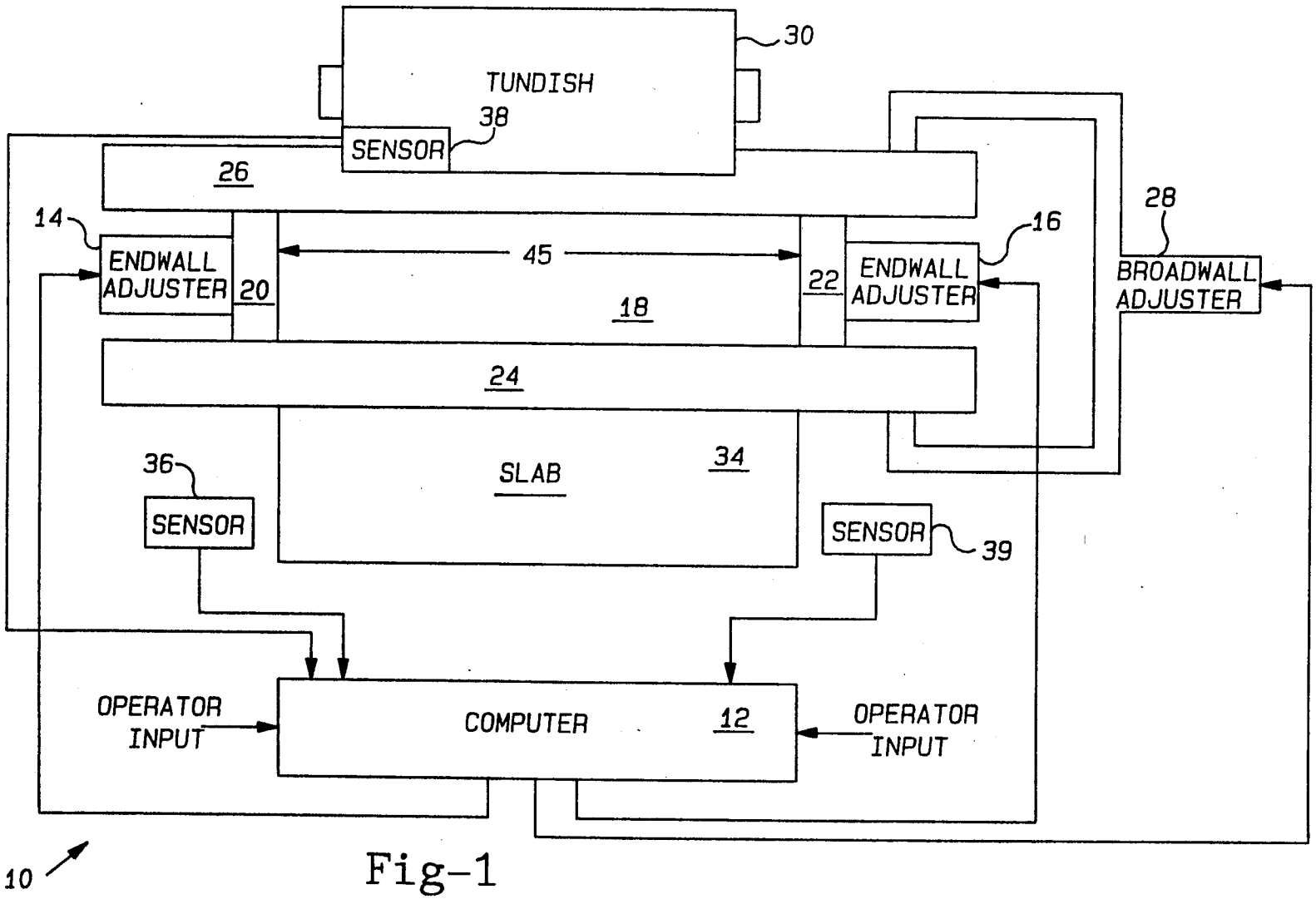
FIG. 1 is a block diagram of a slab width controller made according to the teachings of the preferred embodiment of this invention, and shown in assembled relation with a typical casting mold.

Referring now to FIG. 1, there is shown a slab width controller 10, of the preferred embodiment of this invention, which includes a computer 12 coupled to endwall adjusters 14 and 16 of a typical casting mold 18.

Mold 18 further includes two movable narrow endwalls 20, 22 which are each adapted to be engaged by respective adjusters 14, 16 and, at opposite sides thereof, by broadwalls 24, 26.

Figure 2:
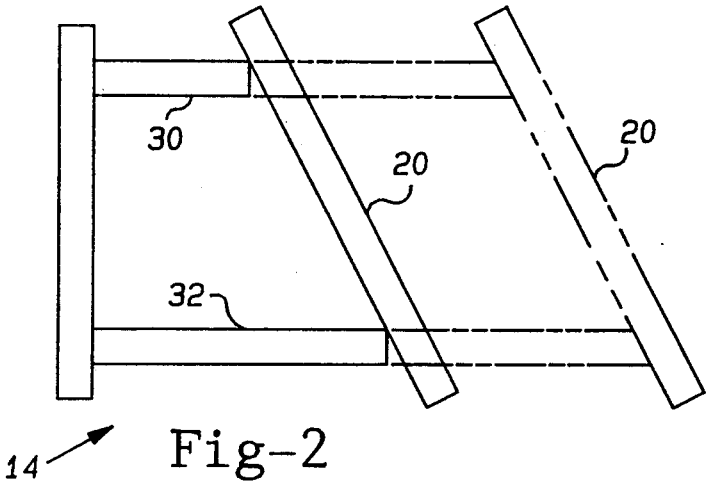
FIG. 2 is a side view of one of the endwalls of the casting mold shown in FIG. 1.
Figure 3D:
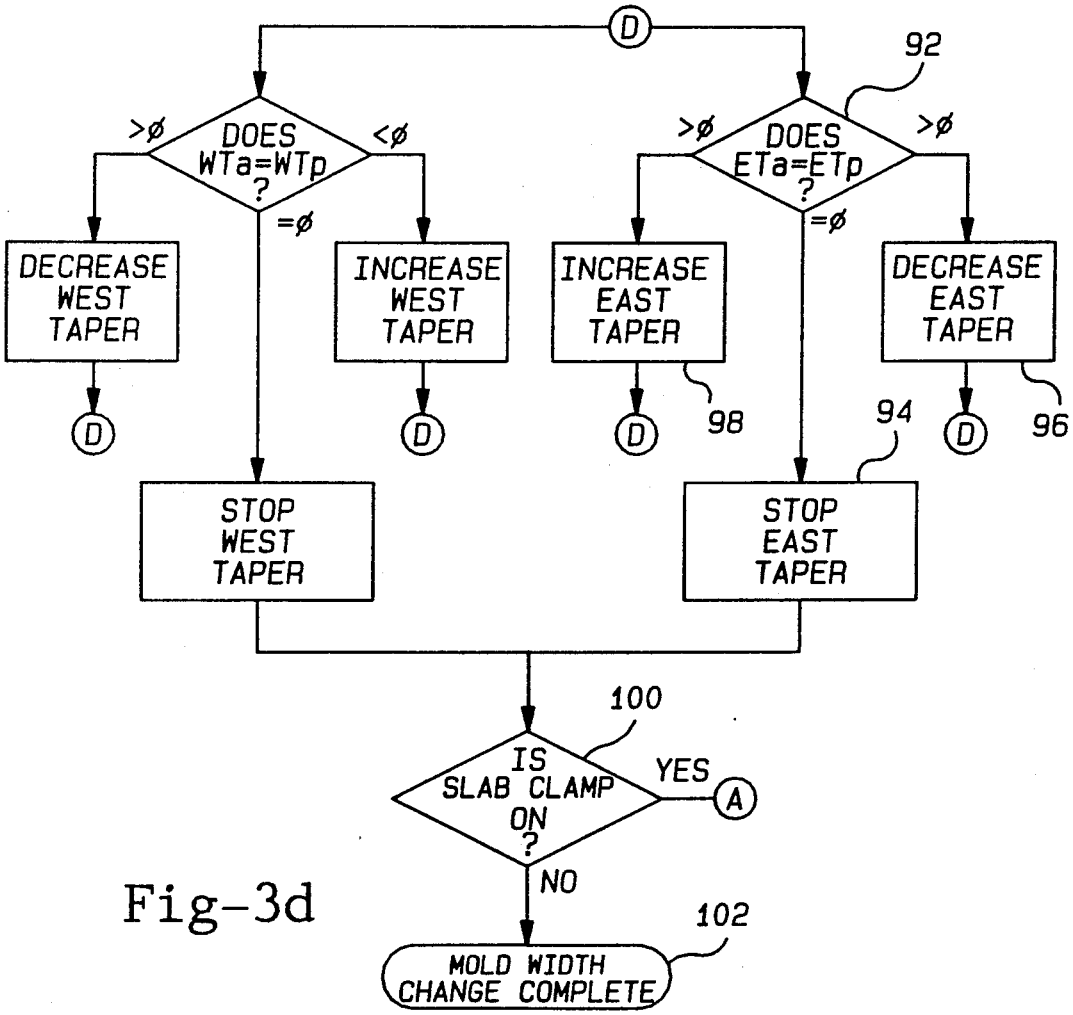
FIGS. 3(A–d) are flow charts describing the sequence of operations associated with the computer of the preferred embodiment of this invention, shown generally in FIG. 1.
Figure 3A:
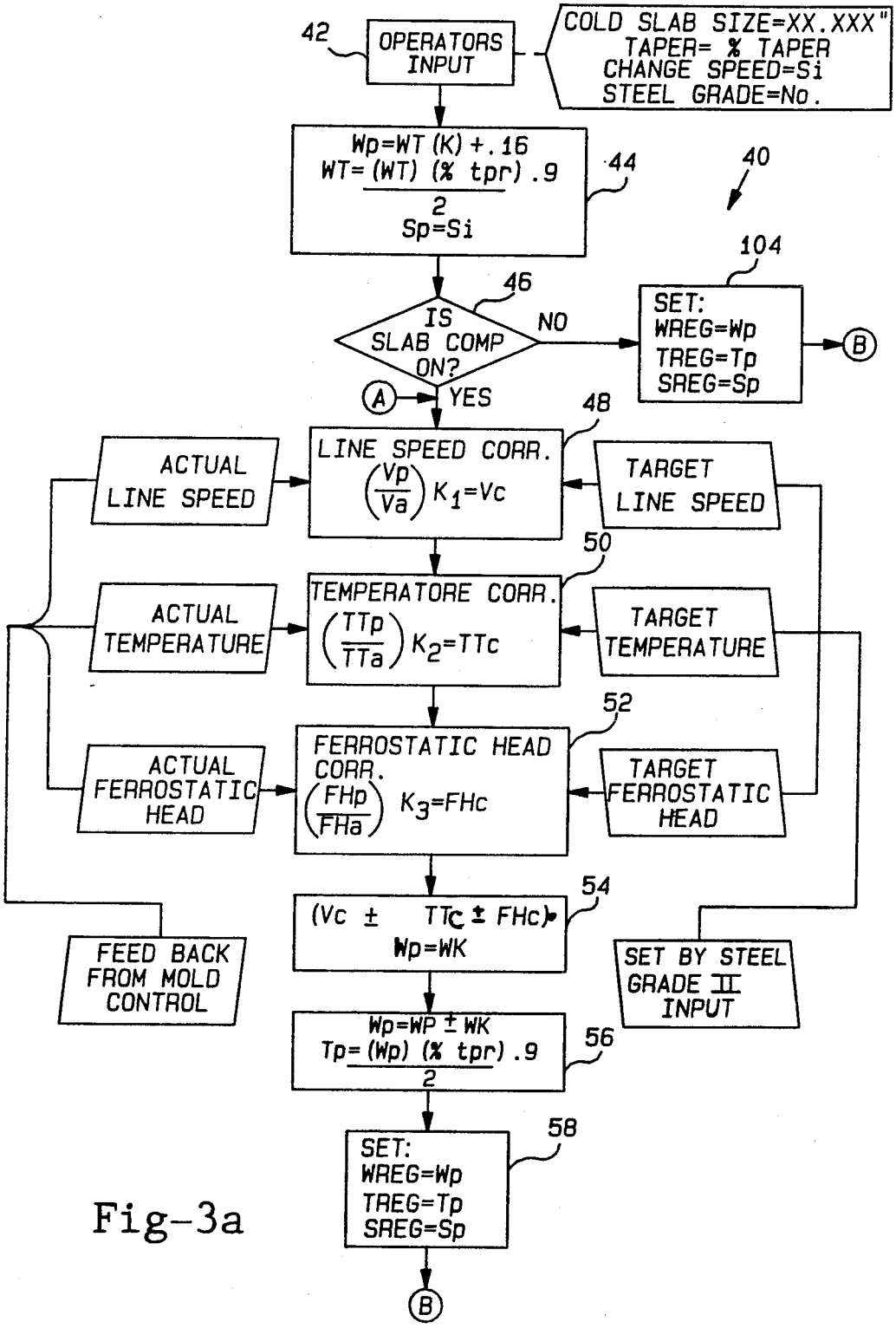
Figure 3B:
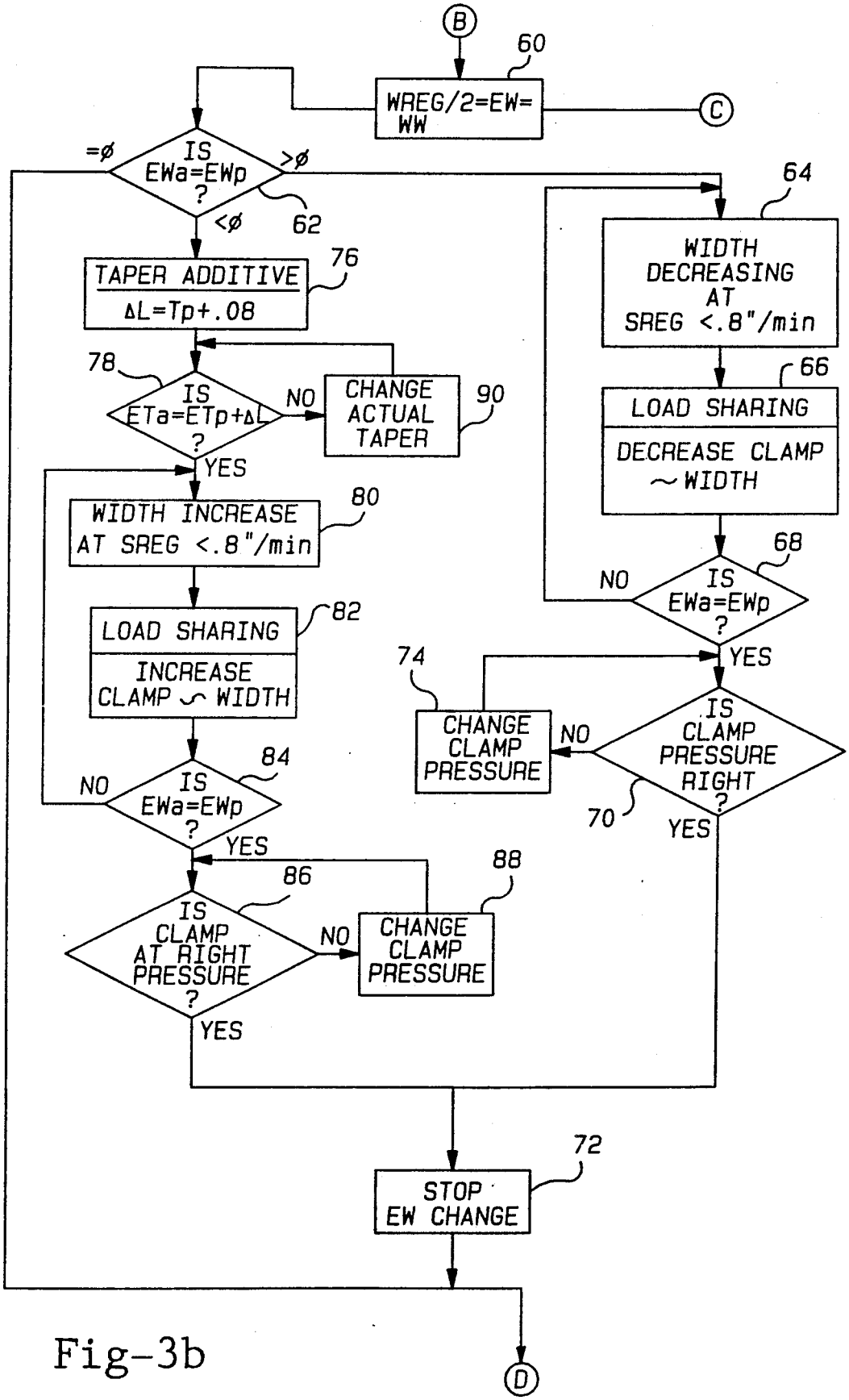
Figure 3C:
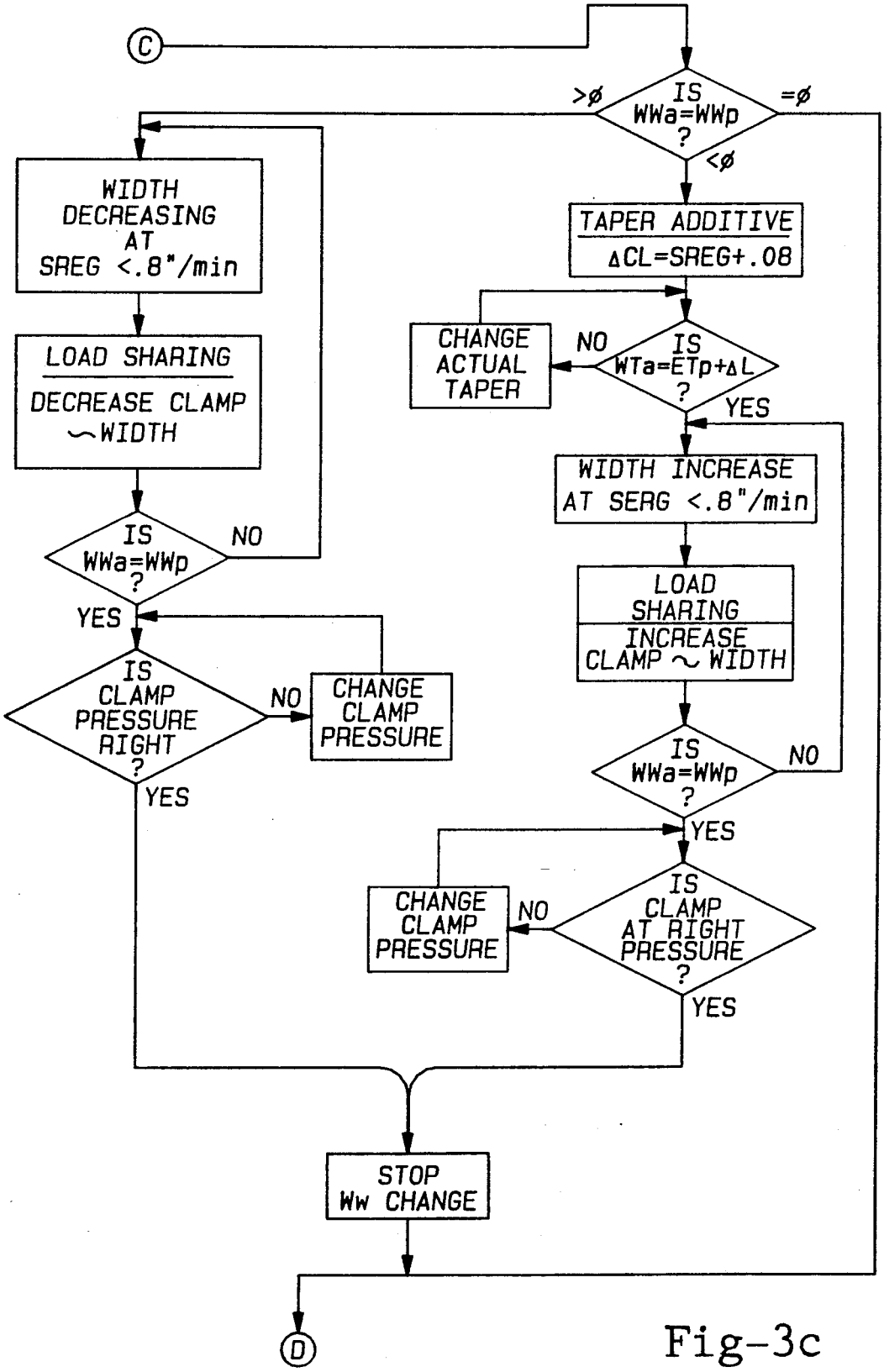

As seen with reference to FIG. 2, each adjuster 14, 16 usually comprises a first telescoping member 30 adapted to modify the taper of a respective endwall 20, 22 and a second telescoping member 32, adapted to cooperate with member 30 in moving the respective endwall 20, 22, thereby changing the width of mold 18.

In normal mold operation, adjusters 14, 16 position endwalls 20, 22 so that a desired top width 45 is achieved. Each endwall 20, 22 is then tapered to ensure continual contact with the molten metal and adjuster 28 is activated to cause broadwalls 24, 26 to engage each of the endwalls 20, 22. The contact between broadwalls 24, 26 and endwalls 20, 22 must be sufficient to prevent any of the received molten metal, poured from tundish 30, from leaking out of mold 18. The received molten metal normally exerts a compressive ferrostatic pressure at the bottom of mold 18, thereby forcing the output of a slab 34 which grows in proportion to the amount of molten metal received by mold 18.

Controller 10 further includes sensors 36, 38 which are coupled to computer 12 and which are respectively adapted to measure the output speed of slab 34 and the temperature of the molten metal, within tundish 30. Additionally, controller 10 includes a sensor 39, coupled to computer 12 and adapted to measure the metallurgical length of slab 34. Alternatively, computer 12 may be adapted to calculate the metallurgical length, in accordance with the teachings of the prior art, by use of the measured output speed. Moreover, computer 12 is adapted to calculate the ferrostatic pressure by use of the measured or calculated metallurgical length.

In operation, computer 12 causes endwalls 20, 22 to be periodically moved in response to the measured molten metal temperature, the measured slab speed, and the calculated pressure, so as to selectively modify the top width 45, thereby causing the production of a slab 34 having a constant and desired width.

To more fully understand the operation of computer 12, reference is now made to FIGS. 3(a–d) where there is shown flow chart 40, illustrating the general sequence of operational steps associated with this invention. It should be realized, by one of ordinary skill in the art, that these steps may be accomplished in a different sequence from that shown and described and that any such sequence modification is intended to be within the scope of this invention.

Specifically, as shown in step 42, an operator of controller 10 initially inputs the grade of steel which is to be molded; the desired slab width; an amount of initial endwall taper; and a desired endwall movement speed, to computer 12. Both the initial taper and speed are determined in accordance with the prior art and are related to the grade of the steel and the desired slab width. Proper setting of these values ensures that endwalls 20, 22 maintain continual contact with the received molten steel 18 and that any necessary endwall movement is prevented from disrupting or deforming slab 34.

Step 42 is followed by step 44 in which computer 12 creates as initial top width variable, denoted as "Wp", and sets the value of this variable equal to the top width necessary to produce a slab having the desired width. This initial value may be obtained from the mold manufacturer or easily derived from the prior art. In the preferred embodiment of this invention, this calculated width is increased by a factor of 0.16 inches in order to correct for scale formation on the solified output slab.

Computer 12 further calculates appropriate endwall tapers by multiplying the initial top width value by the previously input desired taper value. This product is then halved and multiplied by a factor of 0.900 (for a 900 mm high mold) in order to create a calculated taper value. Additionally, computer 12, in step 44, creates an endwall speed variable, denoted as "Sp", and sets this variable equal to the previously input speed. After step 44 is completed, metal is poured into mold 18, and slab casting is begun.

Step 44 is followed by step 46, which requires a system operator to decide whether the slab width control, of this invention, is desired. Step 48 follows step 46 only if the operator desires computerized slab width control.

During step 48, computer 12 receives the measured slab speed from sensor 36 and computes a corrected speed. Specifically, this corrected speed is calculated by dividing the measured speed into a speed necessary to produce a slab 34, having the previously specified and desired width. This necessary speed may be obtained from the mold manufacturer or easily derived from the prior art. The corrected speed value is then multiplied by a value which corrects for sensor measurement errors and which may be obtained from the manufacturer of sensor 36 or easily derived from the prior art.

Step 50 follows step 48 and in this step, computer 12 receives the measured molten metal temperature from sensor 38 and computes a corrected temperature. This computation is done by dividing the measured temperature into the temperature necessary to produce a slab 34, having the previously specified and desired width. This necessary temperature may be obtained from the mold manufacturer or easily derived from the prior art. The corrected temperature value is then multiplied by a value which corrects for sensor measurement errors and which may be obtained from the manufacturer of sensor 38 or easily derived from the prior art.

Step 52 follows step 50 and in this step, computer 12 receives the measured slab metallurgical length from sensor 39 and uses this measurement to calculate the ferrostatic pressure exerted by the received molten metal within mold 18. Computer 12 then calculates a corrected pressure by dividing the calculated pressure into the pressure necessary to produce a slab 34, having the specified and desired width. This necessary pressure may be obtained from the mold manufacturer or easily derived from the prior art. The corrected pressure value is then multiplied by a value which corrects for sensor measurement error. This error correction value may be obtained from the manufacturer of sensor 39 or easily derived from the prior art.

Step 54 follows step 52 and in this step, computer 12 creates a mold width variable, denoted as "Wk", and assigns a value to it. Specifically, this value is computed by adding the current values associated with each of the correction variables of steps 48, 50, and 52, and multiplying this sum by the calculated mold width of step 44.

Step 56 follows step 54 and in this step, computer 12 modifies the mold width value of step 44 by summing it with the current value of variable "WK". Further, computer 12 calculates a new endwall taper value by multiplying the modified mold width value by the value of the previously input and desired taper and then halving this product while multiplying it by a value substantially equal to 0.9.

Step 58 follows step 56 and in this step, computer 12 creates a mold width regulation variable, denoted as "WREG", and assigns it a value substantially equal to the modified mold width value, of step 56. Further, computer 12 creates a mold taper regulation variable, denoted as "TREG", and assigns it a value substantially equal to the taper value of step 56. Computer 12 additionally creates a speed regulation variable, denoted as "SREG", and assigns it a value substantially equal to the value of the endwall speed variable, of step 44.

Step 60 follows step 58 and in this step, computer 12 halves the value of variable "WREG" and uses this value to specify the respective distances between endwall 20 and the center of the mold (denoted as the "west width") and the distance between endwall 22 and the center of the mold (denoted as the "east width"). More particularly, these modified endwall distances are those necessary in order to ensure that a slab is produced having the desired and constant width.

Step 60 is followed by step 62 in which computer 12 measures the actual distance from endwall 22 to the center of the mold, by communicating with adjuster 16, and compares this measured distance with the desired distance, generated in step 60. If the actual distance is greater than the desired distance, step 62 is followed by step 64 in which computer 12 activates adjuster 16 so as to move endwall 22, at a speed specified by the current value of variable "SREG", towards the center of mold 18. To prevent endwall movement type slab deformation, computer 12, in step 64, ensures that endwall 22 is moved at a speed no greater than 0.8 inches per minute.

Step 64 is followed by step 66 in which the pressure that broadwalls 24, 26 exert against endwall 22 is relieved to prevent frictional broadwall damage, caused by the movement of endwall 22. Step 66 is followed by step 68 in which computer 12 determines whether endwall 22 is in the position specified by step 60. If endwall 22 is not in the desired position, step 68 is followed by steps 64 and 66. If computer 12 determines, in step 68, that endwall 22 is in the desired position, step 68 is followed by step 70. In step 70, computer 12 determines whether the broadwall clamping pressure, exerted on endwall 22, is adequate to prevent molten metal from leaking from mold 18. If the clamping pressure is adequate, step 70 is followed by step 72 in which computer 12 prevents further movement of endwall 22. Step 74 follows step 70 if the clamping pressure is not adequate. In step 74, computer 12 increases the force exerted by broadwalls 24 and 26 against endwall 22. Step 74 is then followed by step 70.

Step 76 follows step 62 if, in step 62, computer 12 determines that the actual distance between the center of the mold 18 and endwall 22 is less than the distance calculated in step 60. In step 76, computer 12 calculates a taper modification value by adding a value substantially equal to 0.08 inches to the current value of the "TREG" variable. Step 76 is followed by step 78 in which computer 12 determines whether the actual taper of endwall 22 is equal to the sum of the taper modification value of step 76 and the current value of the "TREG" variable. If these taper values are substantially equal, step 78 is followed by step 80. In step 80, computer 12 causes adjuster 16 to move endwall 22 from the center of mold 18, at the speed specified by the "SREG" variable. To prevent endwall movement slab deformation, computer 12 ensures that endwall 22 is moved at a speed no greater than 0.8 inches per minute.

Step 80 is followed by step 82 in which computer 12 prevents broadwall frictional damage by causing broadwalls 24 and 26 to move away from the center of mold 18 in response to the moving endwall 22. Step 82 is followed by step 84 in which computer 12 determines whether endwall 22 is currently positioned at the distance specified in step 60. If endwall 22 has not assumed the desired position, step 84 is followed by steps 80 and 82. If, in step 84, endwall 22 has reached the desired specified position, step 84 is followed by step 86 in which computer 12 determines whether the pressure, exerted by broadwalls 24 and 26 on opposite sides of endwall 22, is sufficient to prevent molten metal leakage from mold 18. If the exerted pressure is insufficient, step 86 is followed by step 88. In step 88, computer 12 causes broadwalls 24 and 26 to assert additional pressure on opposite sides of endwall 22. Step 88 is followed by step 86. If, in step 86, computer 12 determines that the clamping pressure is adequate, step 86 is followed by step 72.

If, in step 78, computer 12 determines that the actual endwall taper is not equal to the sum of the taper values associated with steps 58 and 76, computer 12 enters step 90. In step 90, computer 12 activates adjuster 16 in order to taper endwall 22 by an amount equal to the current value of the variable "TREG". Step 90 is followed by step 78.

Step 72 is followed by step 92 in which computer 12 determines whether the actual taper of endwall 22 is equal to the current taper value of variable "TREG". If these taper values are equal, step 92 is followed by step 94 in which computer 12 prevents any further taper modification. If the actual taper is greater than the variable value, step 92 is followed by step 96 in which computer 12 causes adjuster 16 to decrease the taper of endwall 22 until the two taper values are substantially equal.

If, in step 92, computer 12 determines that the current taper of endwall 22 is less than the variable taper, step 92 is followed by step 98. In step 98, computer 12 causes adjuster 16 to increase the taper of endwall 22 until the taper values are substantially equal. Step 94 follows step 92 only after these taper values become equal and, in this step, computer 12 prevents any further taper modifications to endwall 22.

Step 94 is followed by step 100 in which computer 12 determines whether further automatic slab width compensation is desired by an operator of system 10. If such automatic slab width compensation is still required, step 100 is followed by step 48. Alternatively, step 100 is followed by step 102 in which computer 12 makes no further mold modifications based upon measured temperature, metallurgical length, and speed values, until requested to do so by a system operator.

Step 104 follows step 46 if the slab width control of this invention was not selected by a system operator, in step 46. In step 104, computer 12 creates the mold width regulation variable, "WREG", and sets the value of this variable equal to the calculated slab width of step 44. Computer 12 further creates the taper regulation variable, "TREG", and sets the value of this variable equal to the calculated taper value of step 44. Lastly, in step 104, computer 12 creates the speed regulation variable, "SREG", and sets the value of this variable equal to the operator input speed. Step 104 is then followed by step 60 and mold modifications are made without regard to measured changes in temperature, speed, or ferrostatic pressure.

It should be realized by one of ordinary skill in the art that slab width controller 10, of the preferred embodiment of this invention, allows for automatic width and taper modifications of mold 18 according to the output speed of slab 34, the temperature of the molten metal within tundish 30, and the pressure exerted by the received metal within mold 18. More particularly, this previously described mold adjustment allows for the production of a steel slab 34 having a desired and substantially constant width associated therewith. It should be further realized by one of ordinary skill in the art that the movement and taper modifications associated with endwall 20, which are also shown in FIGS. 3(*a–d*), are substantially similar to that previously described with respect to endwall 22 and shown in steps 62–102 of FIGS. 3(*a–d*).

It is to be understood that the invention is not limited to the exact construction or method illustrated and described above, but the various changes and modifications may be made without departing from the spirit and scope of the invention as defined in the following claims.

We claim:

1. A controller for use in combination with a continuous casting mold into which molten metal is poured and which is adapted to output a slab of metal therefrom, said controller comprising:

measurement means for measuring the temperature of said molten metal; and width control means, coupled to said measurement means, for specifying a width of said mold based upon said measured temperature and for adjusting said mold so as to cause said mold to have said specified width.

2. A controller for use in combination with a continuous casting mold which is adapted to receive molten metal and to output a slab of metal therefrom, said received molten metal exerting a certain pressure within said mold, said controller comprising:

determining means for determining said certain pressure; and width means, coupled to said determining means, for specifying a width of said mold based upon said determined certain pressure and for adjusting said mold so as to cause said mold to have said specified width.

3. A slab width controller for use in combination with a continuous casting mold into which a quantity of molten metal, having a certain temperature, is poured, said mold being adapted to output, at a certain speed, a metal slab having a certain width associated therewith, said slab width controller comprising:

determining means for determining said certain temperature; and width means coupled to said determining means, for adjusting said mold in accordance with said determined certain temperature, thereby causing the production of a metal slab having a certain and substantially constant width.

4. A slab width controller for use in combination with a continuous casting mold which is adapted to receive metal and to output a metal slab having a certain width associated therewith, said received metal being effective to exert a certain pressure within said mold, said slab width controller comprising:

determining means for determining said certain pressure; and width means, coupled to said determining means, for adjusting said mold in accordance with said determined certain pressure, thereby causing the production of a metal slab having a certain and substantially constant width.

5. A method for producing a slab having a constant width from a continuous casting mold having opposite and movable narrow endwalls, each of said endwalls being adapted to be engaged at opposite sides thereof by movable and opposite broad sidewalls, said mold being adapted to receive molten metal, of a certain grade and having a certain temperature associated therewith, and to output, at a certain speed, a metal slab therefrom, said received molten metal being effective to exert a certain pressure within said mold, said method comprising the steps of:

(a) determining said grade of said molten metal;

(b) determining an initial position for each of said endwalls by use of said determined grade;

(c) placing each of said endwalls at said respective endwall positions;

(d) measuring said temperature;

(e) determining said certain pressure;

(f) measuring said certain speed;

(g) determining a second position for at least one of said endwalls by use of said measured temperature, said determined certain pressure, and said certain speed; and (h) moving at least one of said endwalls to said respective determined second position associated therewith, thereby causing the production of a slab having a certain and constant width.

6. The method of claim 5 further comprising the steps of:

(i) engaging each of said endwalls with said movable and opposite broad sidewalls;

(j) releasing each of said movable and opposite broad sidewalls, from engagement with said endwalls, prior to moving at least one of said endwalls to said respective determined second position; and (k) forcing each of said respective broad sidewalls against each of said endwalls after said at least one of said endwalls has been moved to said respective second position.

7. The method of claim 6 wherein said slab has a certain metallurgical length uniquely associated therewith, said method further comprising the step of:

(l) measuring said metallurgical length.

8. The method of claim 7 further comprising the step of:

(m) determining said certain pressure by use of said measured metallurgical length.

* * * * *